US006530295B1

(12) United States Patent
Scott

(10) Patent No.: US 6,530,295 B1
(45) Date of Patent: Mar. 11, 2003

(54) CORKSCREW SPACER

(76) Inventor: William J. Scott, 604 N. Pinos Altos St., Silver City, NM (US) 88061

( * ) Notice: Subject to any disclaimer, the term of this patent is extended or adjusted under 35 U.S.C. 154(b) by 0 days.

(21) Appl. No.: 09/993,804

(22) Filed: Nov. 6, 2001

(51) Int. Cl.[7] ..... B67B 7/62
(52) U.S. Cl. ..... 81/3.37; 81/3.29
(58) Field of Search ..... 81/3.37, 3.39, 81/3.07, 3.08, 3.09, 3.15, 3.35, 3.36, 3.29, 3.45, 3.55, 3.47, 3.57, 3.56, 3.48

(56) References Cited

U.S. PATENT DOCUMENTS

| | | | | | |
|---|---|---|---|---|---|
| 35,514 | A | * | 6/1862 | Fradgley | 81/3.29 |
| 447,185 | A | * | 2/1891 | Hollweg | 81/3.35 |
| 725,277 | A | | 4/1903 | Newell | |
| 786,492 | A | * | 4/1905 | Garimaldi | 81/3.09 |
| 984,661 | A | * | 2/1911 | Halk | 81/3.37 |
| 4,377,096 | A | | 3/1983 | Allen | 81/3.38 |
| 4,406,182 | A | | 9/1983 | Antone | 81/3.38 |
| 4,658,678 | A | * | 4/1987 | Pracht | 81/3.29 |
| 4,703,673 | A | | 11/1987 | Allen | 81/3.29 |
| 4,727,779 | A | * | 3/1988 | Lee | 81/3.37 |
| 4,756,214 | A | | 7/1988 | Valtri et al. | 81/3.4 |
| 4,800,784 | A | * | 1/1989 | Allen | 81/3.36 |
| 5,005,446 | A | | 4/1991 | Mackey | 81/3.48 |
| 5,086,675 | A | * | 2/1992 | Leung et al. | 81/3.29 |
| 5,367,923 | A | | 11/1994 | Fabbro | 81/3.09 |
| 5,454,282 | A | | 10/1995 | Del Mistro | 81/3.48 |
| 6,179,140 | B1 | * | 1/2001 | Gardner | 215/299 |

* cited by examiner

*Primary Examiner*—Joseph J. Hail, III
*Assistant Examiner*—David B. Thomas
(74) *Attorney, Agent, or Firm*—Durando Birdwell & Janke, PLC

(57) ABSTRACT

A spacer and method for facilitating removal of a cork from a bottle with a corkscrew. The spacer has a bottom surface that abuts the bottle, a top surface that abuts the bottom of a corkscrew, and a side opening that is sufficiently large to receive the cork. Once the corkscrew has been used to partially remove the cork, the spacer is placed around the exposed cork by pulling the body of the corkscrew away from the bottle while the screw is still inserted in the cork and inserting the spacer in the resulting space. Force is then reapplied to completely remove the cork from the bottle. One or more spacers may be attached to the corkscrew by a flexible cord for convenience. In one embodiment, a hinge mechanism interconnects a number of spacers of various thicknesses and opening sizes.

16 Claims, 5 Drawing Sheets

CORKSCREW SPACER

FIELD OF THE INVENTION

This invention relates to devices and methods for removing a cork from a bottle, and particularly to devices and methods that facilitate the use of a corkscrew to remove a cork fully from a bottle with minimal damage to the cork.

BACKGROUND OF THE INVENTION

As is well known, a cork is ordinarily removed from a bottle by threading into the cork a corkscrew having a handle and pulling the cork out of the bottle with the cork screw. There are many variations of corkscrew. In the simplest case, the corkscrew merely has a handle and the cork is removed by pulling on the handle. However, many corkscrew include some type of leverage mechanism to facilitate removal of a cork.

One well-known example of a leveraged corkscrew comprises a body and a rod having a handle at one end, a screw at the other end for insertion into a cork and lever arms for removing the cork. The rod has a cylindrical portion and a plurality of spaced protruding rings that surround a portion of its circumference. The body includes a sleeve through which the rod slides and a base that rests on the rim of the bottle. A pair of lever arms that have protruding teeth at one end are rotatably connected to the body by a pin so that the teeth engage the spaced rings of the rod and thereby translate rotational motion of the lever arms to linear motion of the rod and vice-versa. In use, the screw tip is inserted into the cork by rotating the handle. This rotation causes the rings to moved downward, engaging the gear teeth, and thereby causing the lever arms to move upward. The screw tip is inserted into the cork sufficiently deep that the cork can be at least partially extracted by pushing the lever arms down toward the neck of the bottle.

Similarly, U.S. Pat. No. 5,367,923 discloses a leveraged corkscrew having lever arms with teeth that interact with corresponding teeth on a shaft that contains a screw at one end and a handle at another. Insertion of the screw into the cork causes the lever arms to rise which provides leverage when removing the cork.

A further example of a leveraged corkscrew is shown in U.S. Pat. No. 5,454,282, which discloses a pocket corkscrew that comprises a handle having a lever arm at one end, and a screw disposed between the lever arm and the other end. The lever arm has notches. In use, the screw is inserted into the cork by rotating the handle. A notch on the lever arm is placed over the rim of the bottle to provide leverage. The other end of the handle is pulled upward in an attempt to remove the cork When using corkscrews it is desirable not to insert the screw too deep into the cork because this could possibly damage it. In addition, if the contents of the bottle are to be saved for another time, a hole that extends through the cork may expose the contents of the bottle to air. As a result, the range of motion of the lever arms and the pulling action of the screw often are not sufficient to completely remove the cork from the bottle after a full swing down. Then, in order to completely remove the cork from the bottle, the cork must be jiggled out, which leads to frequent breakage of the cork. The screw can also be inserted further into the cork, but as previously mentioned, this frequently leads to breakage of the cork.

Therefore, there is a need to provide a device that will enable a corkscrew to completely extract a cork from a bottle without damage to the cork.

SUMMARY OF THE INVENTION

The aforementioned need has been met in the present invention by a spacer and method of use thereof that provides additional leverage to a corkscrew. The spacer has a bottom surface that abuts the rim of a bottle, a top surface that abuts the bottom of a corkscrew, and a side opening that is sufficiently large to receive the cork. Once the corkscrew has been used to partially remove the cork, the spacer is placed around the exposed cork by pulling the body of the corkscrew away from the rim of the bottle while the screw is still inserted in the cork, thereby opening a space between the rim of the bottle and the bottom of the corkscrew, and inserting the spacer in that space. Force can then be reapplied to completely remove the cork from the bottle. The spacer can be used with any corkscrew that extracts a cork while pushing against the rim of the bottle. One or more spacers may be attached to the corkscrew by a flexible cord for convenience. In one embodiment, a hinge mechanism interconnects a number of spacers of various thicknesses and hole sizes. Preferably, the hinge mechanism is a rod that is placed through a hole formed in each spacer so as to align the spacers along an axis of rotation. When a certain spacer is needed, it is rotated out of alignment for placement between the rim of the bottle and the bottom of the corkscrew.

Therefore it is a principle object of the invention to provide a device and method that will enable a corkscrew to completely extract a cork from a bottle.

It is another object of the invention to provide a device and method for providing additional leverage to a corkscrew.

It is a further object of the invention to provide a device and method of removing a cork from a bottle without damaging the cork.

DETAILED DESCRIPTION OF THE INVENTION

Figure 1:
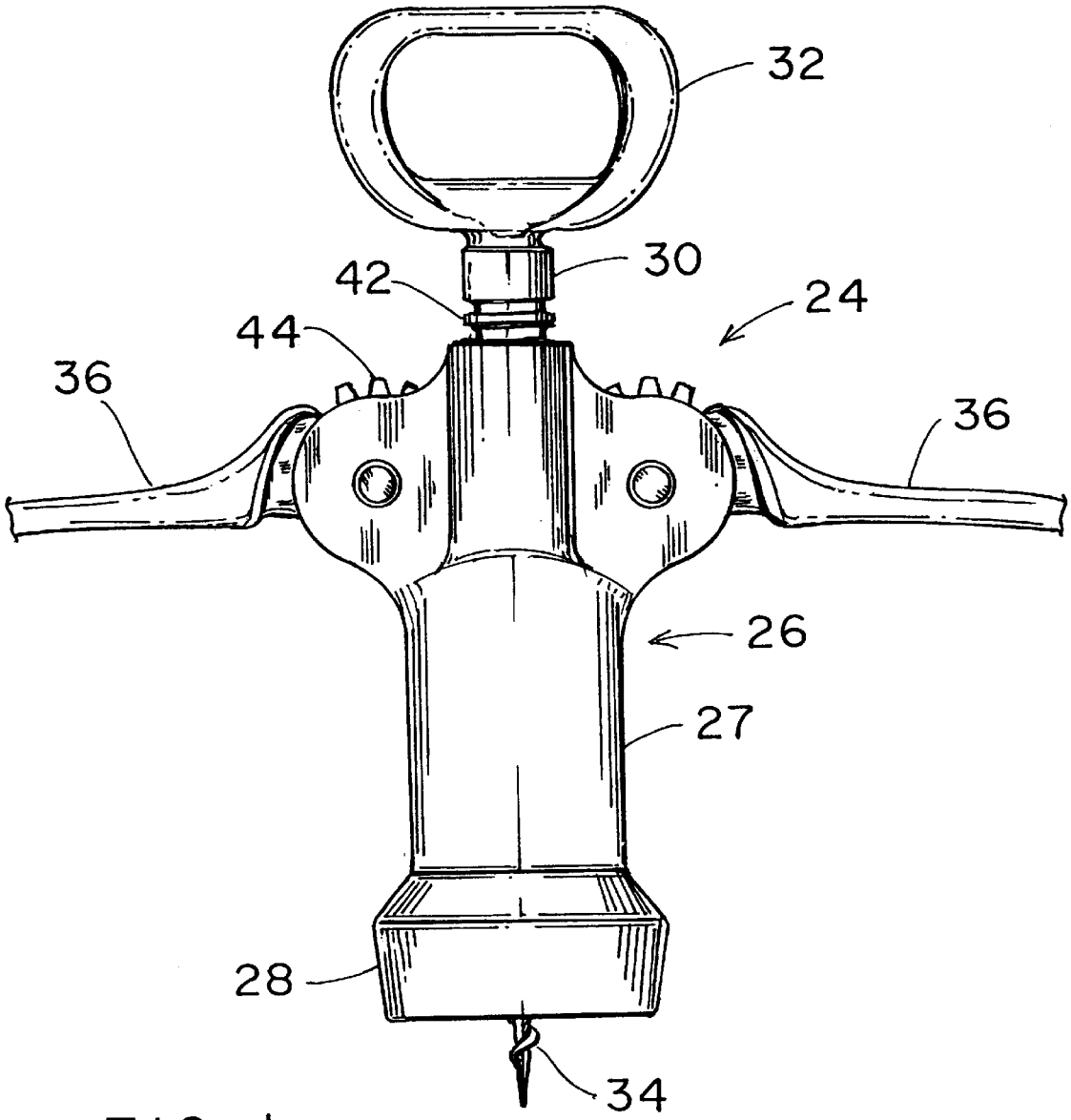
FIG. 1 (PRIOR ART)
FIG. 1 is a front view of an exemplary prior art lever-arm corkscrew that can be used in conjunction with the present invention.
Figure 2:
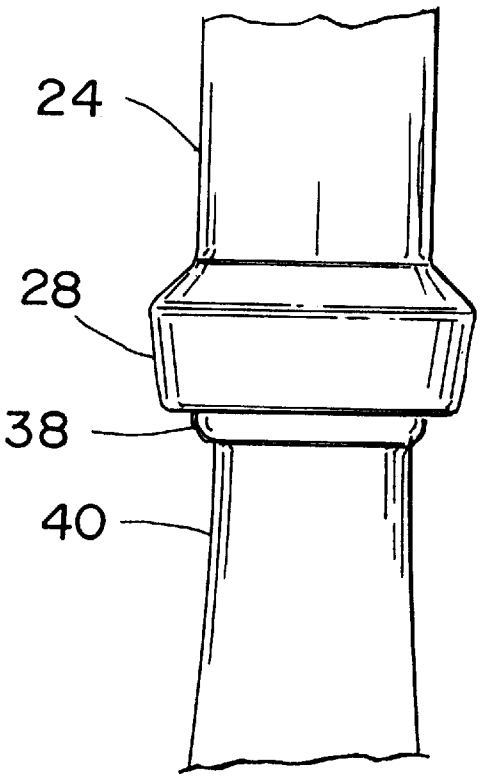
FIG. 2 (PRIOR ART)
FIG. 2 is a front view of the exemplary prior art lever-arm corkscrew of FIG. 1 wherein the screw has been inserted into the cork of a bottle.
Figure 3:
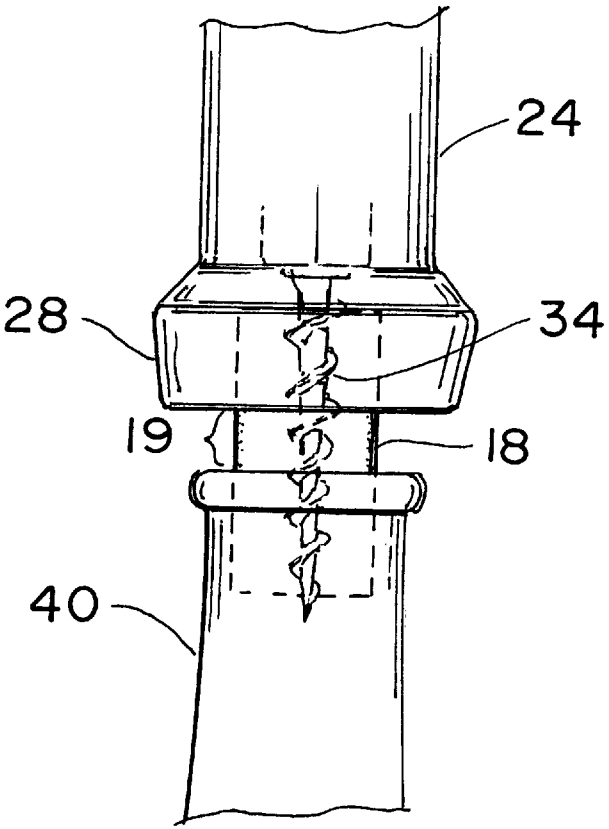
FIG. 3 (PRIOR ART)
FIG. 3 is a front view of the exemplary prior art lever-arm corkscrew of FIG. 1 wherein the cork has been partially removed from the bottle.

An example of a typical prior art corkscrew 24 that can be used with the present invention is shown in FIG. 1. The corkscrew 24 has hollow body 26 including a base 28. A rod 30 is slidingly engaged with the body 26 through a sleeve 27. The rod 30 has a handle 32 at one end and a screw 34 at the other end. Lever arms 36 are pivotally attached to the body 26. In use, the screw 34 is placed on top of the cork 18 and the handle 32 is turned, which rotates the screw 34 causing it to engage and advance into the cork 18. As shown in FIG. 2, the screw 34 is rotated until the base 28 of the corkscrew body rests against the rim 38 of the bottle 40. A rack and pinion system is used to raise the lever arms 36. As the screw 34 advances into the cork 18, rings 42 on the rod 30 engage teeth 44 on the lever arms 36 causing the lever arms 36 to rise. The lever arms 36 are then pressed down, which pushes the base 28 of the corkscrew body 24 against the rim 38 of the bottle and causes the screw 34 to rise relative to the body of the corkscrew 24, which pulls the cork 18 upward and at least partially out of the bottle. As shown in FIG. 3, a disadvantage of the corkscrew 24 is that frequently the cork 18 does not fully come out of the bottle 40 due to the limited range of motion of the lever arms 36 and the pulling action of the screw 34.

Although the invention is described hereafter in use, for example, with the aforedescribed typical corkscrew, it is to be recognized that the invention is not limited to use with this typical corkscrew. Indeed, it may be used with other types of corkscrews where mechanical advantage can be gained by inserting the device of the invention between a portion of the corkscrew and the top of a bottle after a cork has been partially removed.

Figure 4A:
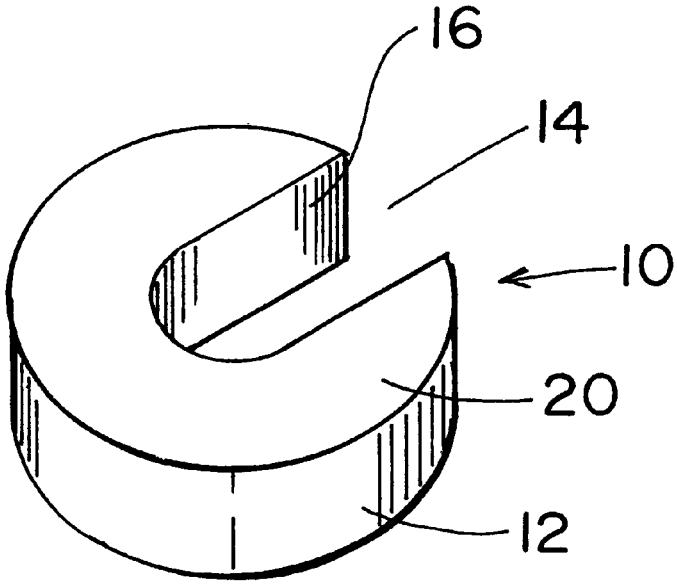
FIG. 4*a* shows a spacer according to the present invention.
Figure 4B:
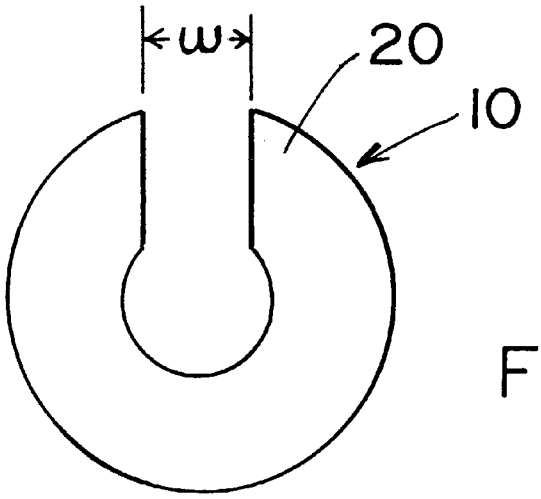
FIG. 4*b* is a top view of the spacer of FIG. 4*a*.
Figure 4C:
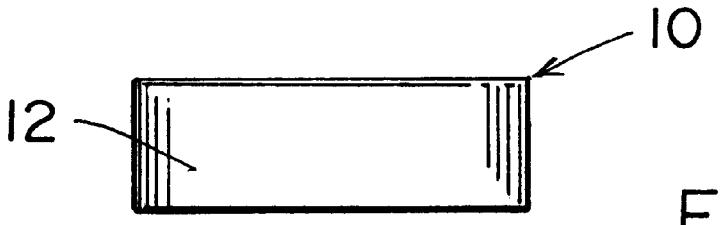
FIG. 4*c* is a side view of the spacer of FIG. 4*a*.
Figure 5:
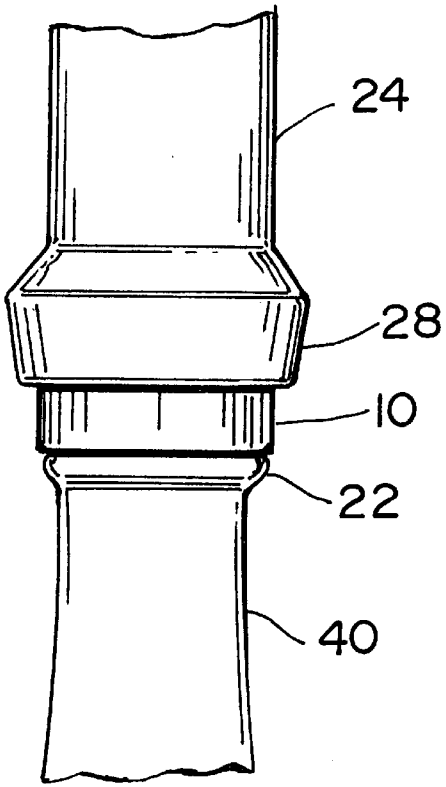
FIG. 5 is a side view of the spacer of FIG. 4*a* inserted around a cork and between a bottle and a corkscrew.

A preferred embodiment of a spacer 10 according to the present invention is shown in FIGS. 4*a*–5. As shown in FIG. 4*a*, the spacer 10 preferably has a substantially circular configuration. The spacer 10 includes a side surface 12. An opening or slot 14 having an inside surface 16 extends from the side surface 12 into the center of the spacer 10. The opening 14 has a width w that allows the spacer to fit around a cork 18 partially removed from a bottle 40, as shown in FIG. 3. The spacer 10 further includes a top surface 20 for abutment against the base 28 of a corkscrew 24 and a bottom surface 22 (FIG. 5) for abutment against the rim 38 of a bottle 40. Although the illustrated spacer 10 has a circular configuration, other configurations may be used without departing from the principles of the invention.

As shown in FIGS. 3, 4*a*, 4*b* and 5, when a cork 18 is partially removed, the base 28 of the corkscrew 24 is raised so as to produce a space 19 between the top of the bottle 40 and the base 28 of the corkscrew 24. The spacer 10 is then inserted into the space 19 so that its side opening 14 fits around the cork 18. The top surface 20 of the spacer 10 then abuts the base 28 of the corkscrew, and the bottom surface 22 of the spacer 10 rests on the rim 38 of the bottle 40. Raising the base 28 causes the lever arms 36 to rise once again due to the rack and pinion system. Once the spacer 10 is inserted, the lever arms 36 are again pressed downward, which causes the screw 34 to rise and pull the cork 18 completely out of the bottle 40. In this manner, the cork 18 can be completely removed from the bottle 40 without risking damage to the cork 18 by advancing the screw 34 further into it, or by jiggling it out by hand.

It is to be recognized that other types of corkscrews may have alternative mechanisms for advancing the screw relative to the base of the corkscrew, rather than lever arms. For example, a rotatable knob might be used. It is to be understood that the device and method of the present invention would be applicable to such other types of corkscrews.

Figure 7:
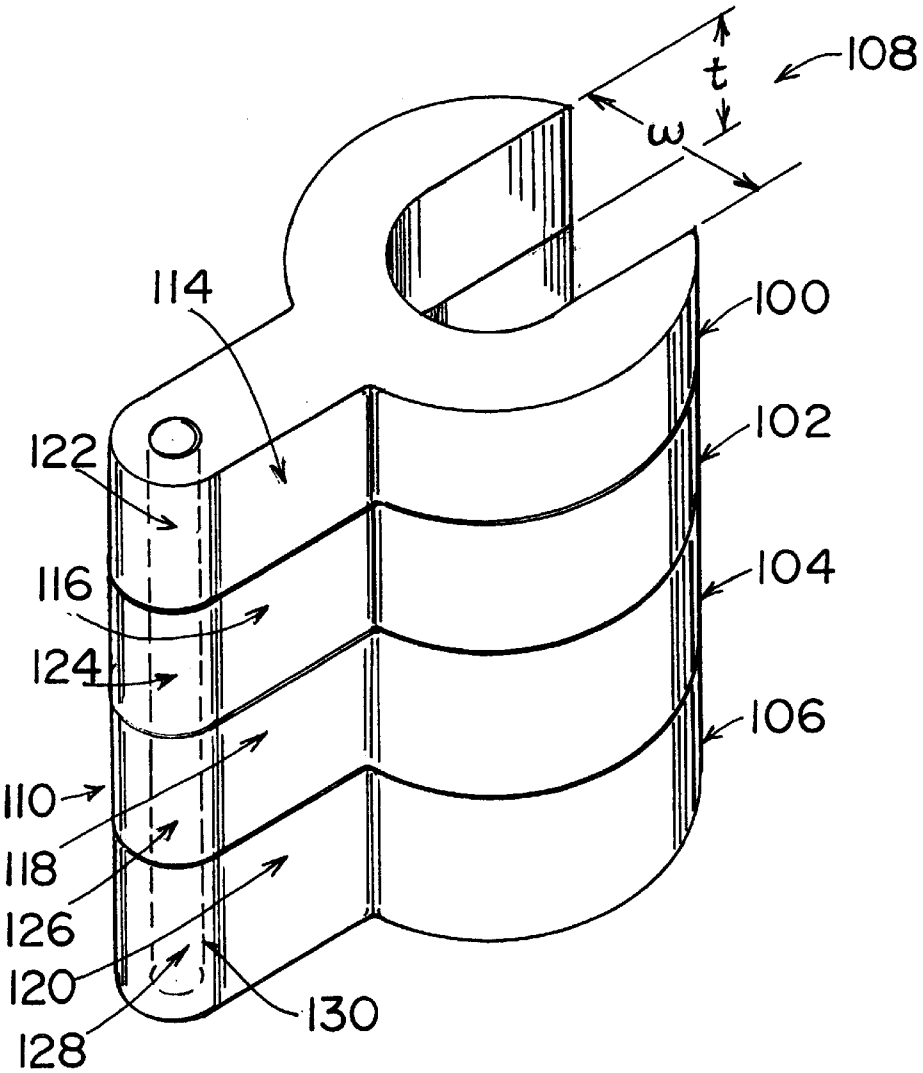
FIG. 7 is a perspective view of a hinged spacer assembly according to the present invention.
Figure 6:
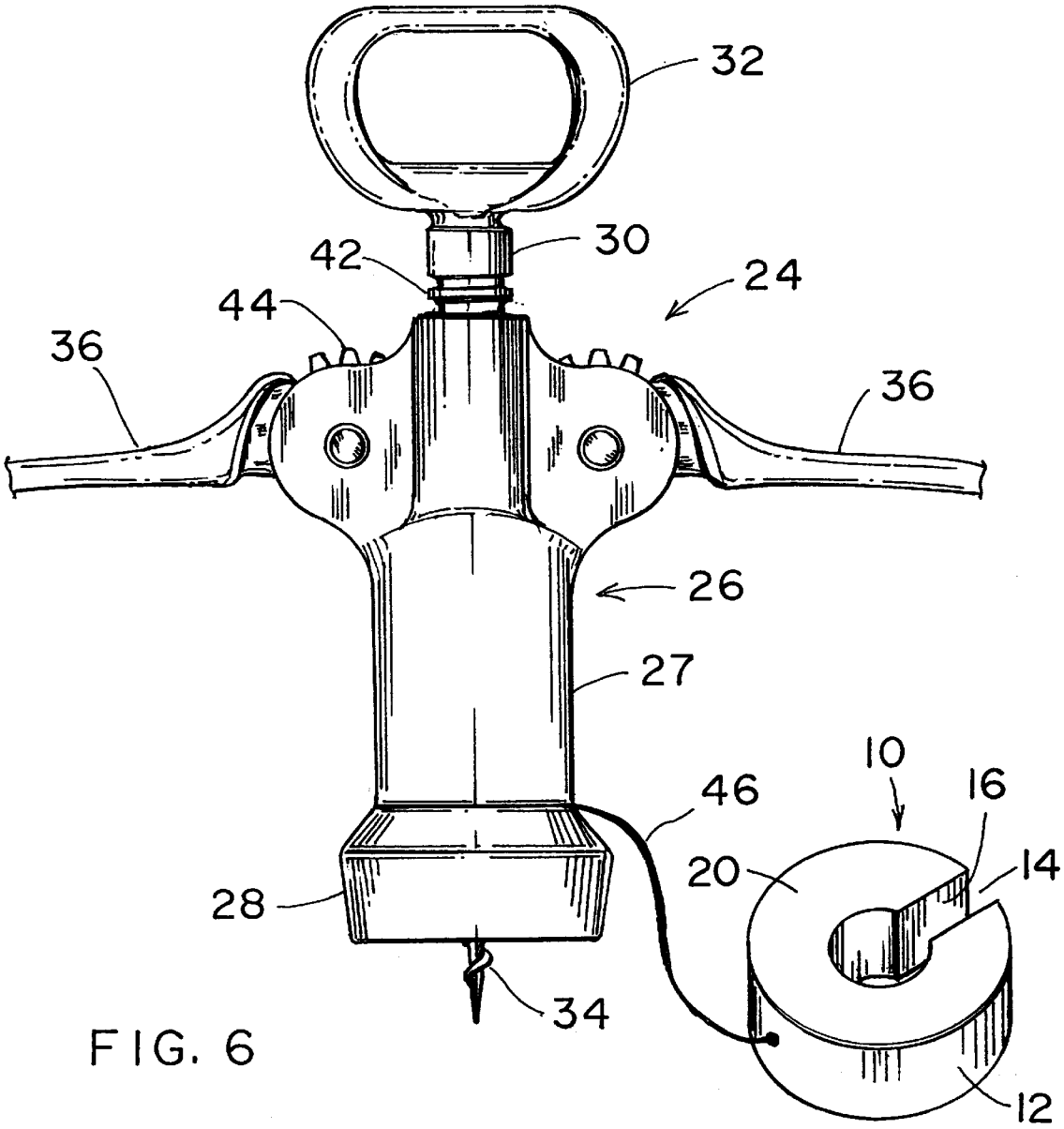
FIG. 6 is a partially perspective view of the prior art lever-arm corkscrew of FIG. 1 with a spacer attached.

The spacer 10 may be provided as an accessory along with a corkscrew 18. Alternatively, the spacer can be attached to the corkscrew 18 by means of a flexible cord, string or wire 46, as shown in FIG. 6. In addition, a plurality of spacers with apertures of varying size can be provided. FIG. 7 shows a plurality of spacers 100–106 that have apertures 108 of various thickness t. The width w of the spacers 100–106 may also vary. A hinge mechanism 110 interconnects the plurality of spacers 100–106. The hinge mechanism 110 preferably comprises a tab 114–120 on each spacer 100–106 with a hole 122–126 formed therethrough. A rod 130 is inserted through the respective holes 122–128 of the spacers so that the spacers 100–106 are aligned along the rod 130. When a particular size spacer is desired, the spacer is rotated out of alignment and inserted in the space 19 between a bottle and corkscrew.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the claims which follow.

I claim:

1. A device for removing a cork from a bottle, comprising:

a corkscrew having a screw for threading engagement with a cork in a bottle, and a base for abutment against the bottle; and a spacer having a bottom surface for abutment against the bottle, a side surface having an opening for receiving said cork laterally, and a top surface for abutment against said base of said corkscrew, said spacer being adapted for insertion between the bottle and said base of said corkscrew after said screw has engaged the cork to facilitate removal of the cork from the bottle.

2. The apparatus of claim 1, further comprising an attachment member that attaches said spacer to said corkscrew.

3. The apparatus of claim 2, wherein said attachment member is a cord.

4. The apparatus of claim 1, wherein said corkscrew further comprises a body with said base disposed at one end, and at least one lever arm pivotally attached to said body for rotational engagement with said screw for pulling said screw into said body when said lever arms are forced toward said base.

5. A spacer assembly for use with a corkscrew having a screw for threading engagement with a cork in a bottle, and a base for abutment against the bottle, comprising:

a plurality of spacers, each spacer having a bottom surface for abutment against the bottle, a side surface having an opening for receiving the cork laterally, and a top surface for abutment against the base of the corkscrew, said spacers being adapted for insertion between the bottle and the base of the corkscrew after the screw has engaged the cork to facilitate removal of the cork from the bottle; and a hinge mechanism interconnecting said plurality of spacers so that said spacers are disposed substantially adjacent one another and can rotate about an axis substantially perpendicular to said bottom and top surfaces thereof to be placed alternatively between the rim of the bottle and the base of the corkscrew.

6. The assembly of claim 5, wherein the thickness from said bottom surface to said top surface of said spacers differs for said plurality of said spacers.

7. The assembly of claim 5, wherein the size of said opening in said side of said spacers differs for said plurality of said spacers.

8. The assembly of claim 5, wherein each of said spacers includes an outwardly extending tab for engagement with said hinge mechanism.

9. The assembly of claim 8, wherein said hinge mechanism comprises a rigid rod and said tabs include apertures therethrough for receiving said rod so that said spacers may rotate around said rod.

10. A method of removing a cork from a bottle, comprising:

providing a corkscrew having a screw for threading engagement with a cork in a bottle, and a base for abutment against the bottle;

providing a spacer having a bottom surface for abutment against the bottle, a side surface having an opening for receiving the cork laterally, and a top surface for abutment against the base of the corkscrew;

engaging the bottle with the corkscrew by screwing the screw into the cork so that the base of the corkscrew can engage the bottle;

partially removing the cork from the bottle by forcing the base of the corkscrew against the bottle while retracting the screw;

pulling the base of the corkscrew away from the bottle so as to produce a space therebetween;

inserting the spacer in said space around said cork; and engaging the spacer with the corkscrew by forcing the base of the corkscrew against the spacer while retracting the screw so as to remove the cork form the bottle.

11. The method of claim 10, wherein the corkscrew further comprises a body with the base disposed at one end, and at least one lever arm pivotally attached to the body and rotationally engaged with the screw for pulling the screw into the body when the lever arms are forced toward the base, said method further comprising, in the fourth and seventh steps, forcing the lever arm toward the base.

12. The method of claim 10, further comprising choosing the spacer from among a plurality of spacers having differing thicknesses from said bottom surface to said top surface thereof.

13. The method of claim 10, further comprising choosing the spacer from among a plurality of spacers having differing slot sizes.

14. The method of claim 10, wherein the spacer is a selected from one of a plurality of spacers, each spacer having a bottom surface for abutment against the rim of the bottle, a side surface having an opening for receiving the cork laterally, and a top surface for abutment against the base of the corkscrew, and a hinge mechanism interconnecting the plurality of spacers so that the spacers are disposed substantially adjacent one another and can rotate about an axis substantially perpendicular to said bottom and top surfaces thereof, said method further comprising rotating the selected spacer relative to the other spacers of said plurality of spacers so as to be out of alignment therewith, and inserting the selected spacer between the rim of the bottle and the base of the corkscrew.

15. A spacer for facilitating removal of a cork having a predetermined diameter from a bottle using a corkscrew, comprising an element having a bottom surface for abutment against the bottle and a top surface for abutment against the corkscrew, said bottom surface and said top surface being spaced apart from one another a predetermined distance, said spacer further comprising a side opening formed therein for receiving the cork where said spacer is placed between the bottle, the corkscrew has threadingly engaged the cork and the cork has been partially removed from the bottle by the corkscrew, said side opening having a width larger than the predetermined diameter of the cork.

16. The spacer of claim 15 wherein the bottle has a neck with a predetermined outside diameter and said width of said side opening is less than the predetermined outside diameter of the bottle neck.

* * * * *